US006317019B1

(12) United States Patent
Herpin et al.

(10) Patent No.: US 6,317,019 B1
(45) Date of Patent: Nov. 13, 2001

(54) LOW-VOLTAGE MULTIPOLE CIRCUIT BREAKER WITH HIGH ELECTRODYNAMIC RESISTANCE, WHEREOF THE POLE SHAFT IS ARRANGED IN THE COMPARTMENT HOUSING THE POLES

(75) Inventors: Jean-Philippe Herpin, Les Marches; André Raso, Claix; Jean-Pierre Nebon, Saint Martin le Vinoux, all of (FR)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/719,876

(22) PCT Filed: Jun. 7, 1999

(86) PCT No.: PCT/FR99/01329

§ 371 Date: Dec. 19, 2000

§ 102(e) Date: Dec. 19, 2000

(87) PCT Pub. No.: WO99/67800

PCT Pub. Date: Dec. 29, 1999

(30) Foreign Application Priority Data

Jun. 24, 1998 (FR) ..... 98/08174

(51) Int. Cl.[7] ..... H01H 75/00; H01H 13/04; H01H 9/02

(52) U.S. Cl. ..... 335/8; 335/6; 335/9; 335/202; 200/293; 200/303

(58) Field of Search ..... 335/6, 8, 9, 10, 335/11, 20, 21, 22, 35, 36, 38, 172–176, 202; 200/293, 303

(56) References Cited

U.S. PATENT DOCUMENTS

| | | | | |
|---|---|---|---|---|
| 4,764,650 | | 8/1988 | Bur et al. | 200/564 |
| 4,958,135 | | 9/1990 | Baginski et al. | 335/8 |
| 5,899,323 | * | 4/1999 | Rakus | 200/244 |
| 6,002,313 | * | 12/1999 | Mrenna et al. | 335/202 |

FOREIGN PATENT DOCUMENTS

| | | |
|---|---|---|
| 0 225 207 | 6/1987 | (EP) . |
| 0 322 321 | 6/1989 | (EP) . |

* cited by examiner

*Primary Examiner*—Ramon M. Barrera
(74) *Attorney, Agent, or Firm*—Parkhurst & Wendel, L.L.P.

(57) ABSTRACT

A low-voltage multipole circuit breaker with high electrodynamic strength comprises a case made of insulating material, subdivided into a front compartment housing an operating mechanism commanding opening and closing of the circuit breaker and a rear compartment separated from the front compartment by an intermediate wall. The rear compartment is itself subdivided into individual compartments by separating partitions, each individual compartment housing one of the poles of the circuit breaker. The operating mechanism is linked to a pole shaft common to all the poles. The pole shaft is located in the rear compartment and supported by bearings passing through the separating partitions.

6 Claims, 8 Drawing Sheets

LOW-VOLTAGE MULTIPOLE CIRCUIT BREAKER WITH HIGH ELECTRODYNAMIC RESISTANCE, WHEREOF THE POLE SHAFT IS ARRANGED IN THE COMPARTMENT HOUSING THE POLES

BACKGROUND OF THE INVENTION

The invention relates to a high-current, low-voltage multipole circuit breaker with high electrodynamic strength. In the past, high-current circuit breakers (for indication purposes between 630 A and 6300 A) acting as base switchgear apparatuses for the incomers and feeders in large power installations, were formed by composite elements assembled on a metal frame, whence them being given the name of "open" power circuit breakers. But progressively the equipment of this range inherited of part of the technology of lower power circuit breakers, called "molded case" circuit breakers because they are characterized by an insulating protective enclosure, generally molded in reinforced polyester, housing the poles with their extinguishing chambers, and an operating mechanism and trip devices. The protective enclosure, by contributing to ensuring confinement of breaking and limitation of its external effects, integral partitioning between poles and a better insulation between the power circuit and the auxiliaries, in return enabled the overall dimensions of these apparatuses to be reduced.

The document EP-A-0,322,321 describes a circuit breaker of this type, whose case is formed by assembly of an intermediate case, of the cover forming the circuit breaker front panel, and of a rear panel. The front face of the intermediate case divides the case into a front compartment bounded by this face and by the cover, and a rear compartment designed for housing the poles and electrically insulated from the front compartment. The front compartment houses an operating mechanism acting on a transverse switching shaft common to all the poles, called the pole shaft. This shaft is supported by bearings fitted on the front face of the intermediate case. The rear compartment is for its part subdivided by insulating separating partitions into individual compartments for housing the poles. The front wall of the intermediate case comprises in addition, for each pole, an aperture for access to the corresponding individual compartment. Each pole comprises a pair of separable contacts with a stationary contact and a movable contact, and an arc extinguishing chamber. Each movable contact is mechanically linked to the transverse shaft by means of a connecting rod passing through the front wall of the intermediate case via the corresponding access aperture.

Each rod connecting one of the movable contacts to the transverse shaft is arranged in such a way that in the closed position of the contacts, and in a plane of straight cross-section perpendicular to the pivoting axis of the pole shaft, the distance between a straight line passing through the rotation axes of the connecting rod and the pivoting axis of the shaft is small. In other words, the leverage of the resultant of the forces exerted by the contacts on the pole shaft is small which guarantees that the connecting rod, when it transmits large electrodynamic forces, only generates a low torque at the level of the shaft. At static equilibrium in the closed position of the contacts, the operating mechanism exerts on the shaft a torque opposing the electrodynamic forces transmitted by the connecting rods. This torque only generates low forces at the level of the operating mechanism. Moreover, the resultant of the reaction forces at the level of the guide bearings of the shaft is great and opposes the forces transmitted by the connecting rod and by the operating mechanism.

This architecture is characteristic of circuit breakers with high electrodynamic strength. These circuit breakers must in fact by definition, in order to achieve time selectivity in the electrical installation, be able to withstand the flow of established fault currents which generate large electrodynamic forces tending to separate the contacts. The relative arrangement of the pole shaft, of the connecting rods with the movable contacts and of the connecting rod to the operating mechanism must be such that these forces do not give rise to separation of the contacts or to opening of the operating mechanism. In this case, the arrangement chosen enables these forces to be transmitted to the case by means of the shaft bearings so that the operating mechanism is not subjected to too great forces or torques.

However, guiding of the pole shaft and transmission of the forces to the circuit breaker case are not completely satisfactory. The transverse shaft must in fact be dimensioned, disposed and supported in such a way that deformation thereof is limited and does not hinder its operation. Furthermore, the pole shaft bearings need to be well secured in the case as the large forces transmitted to them tend to tear them away from the front face of the intermediate case to which they are fixed. Making the assembly rigid imposes the use of costly and bulky fixing parts and bearings and of complementary arrangements on the case. Assembly of the circuit breaker requires a large number of parts resulting in a high cost price and fastidious fitting. This architecture moreover limits miniaturization of the circuit breaker.

Moreover, the numerous openings for passage of the connecting rods between the pole shaft and each of the poles are detrimental to the tightness of the extinguishing chambers. However the electrical arc and the endothermal vaporizations generated by this arc at the level of certain elements of the extinguishing chamber partitions give rise to an overpressure and of a gas flow which has to be channeled towards the outlet orifices provided with suitable filters. In order not to hamper inlet of the arc to the extinguishing chamber, it is judicious to place these outlet orifices at the bottom of the extinguishing chambers. The presence of the openings for passage of the connecting rods, situated just above the contacts at the inlet of the chambers, therefore considerably hampers the flow of the gases to the outlet orifices. It allows an uncontrolled gas flow through the front compartment and the openings of the front face, directly to the outside, without any protective filter.

SUMMARY OF THE INVENTION

The object of the invention is therefore to overcome the drawbacks of the prior art and in particular to increase the rigidity of the mechanism of a circuit breaker with high electrodynamic strength, at low cost.

According to the invention, this problem is solved by means of a low-voltage circuit breaker of high electrodynamic strength with a case made of insulating material, comprising an operating mechanism linked to a pole shaft supported by bearings securedly affixed to the case, a plurality of poles, each pole comprising at least one pair of separable contact parts, one at least of the contact parts of each pair, called the movable contact part, being mechanically linked to the pole shaft, the pole shaft, operating mechanism and movable contact part being able to move between an open position corresponding to separation of the contact parts of each pair, and a closed position corresponding to contact between the contact parts of each pair, the case of the circuit breaker comprising a front compartment housing the operating mechanism and a rear compartment separated from the front compartment by an intermediate wall and subdivided into individual compartments by separating partitions, each individual compartment housing one of the poles of the circuit breaker, a circuit breaker whose rotation axis of the pole shaft is located in the rear compartment.

In state of the technique devices whose pole shaft was situated in the front compartment, a minimum distance had to be provided between the pole shaft and the movable contact parts in the open position. The link between the movable contact parts and the shaft was in fact made through the intermediate wall between the front compartment and the rear compartment. The configuration according to the invention to enables this distance to be considerably reduced and even eliminated, as there is no longer any part placed between the shaft and the contact parts. The overall dimensions of the device can thus be reduced.

This arrangement also enables the electrodynamic forces exerted on the contacts to be taken up by the case, without giving rise to large deformations of the intermediate parts. It in fact becomes possible to place the support bearings in the rear compartment. If these bearings are scheduled to be secured at least partially to the intermediate wall, it is then easy to make the securing parts work in compression instead of working in tear, in response to the electrodynamic forces exerted on the movable contact parts.

Furthermore, this arrangement enables the orifices for passage of the connecting rods between the pole shaft and each movable contact part to be eliminated. Pollution of the front compartment is thereby reduced and flow of the breaking gases to the outlet orifices of the base of the extinguishing chamber is improved.

Assembly is made easier by the fact that it is no longer necessary to fit the link between the pole shaft and each connecting rod via orifices of the intermediate partition.

Each of the separating partitions preferably supports one of said bearings and the pole shaft passes through each partition at the level of one of said bearings. This arrangement enables the bearings to be multiplied and to be distributed regularly along the pole shaft, without increasing the overall dimensions of the assembly. Alternatively, it is also possible to provide for the bearings to be arranged between the separating partitions of the chambers, on autonomous supports. Advantageously, each of the separating partitions comprises a partition element molded with the intermediate wall, in an edge of which there is formed a semi-cylindrical sector forming a part of the corresponding bearing. A multifunctional part is thus obtained which makes assembly easier and reduces costs.

Advantageously, the intermediate wall comprises a window for passage of a mechanical link part between the pole shaft and the operating mechanism.

Preferably, the external surface of the pole shaft is made of electrically insulating material, in particular of thermosetting polyester plastic. This arrangement enables the electrical insulation both between the poles and with the operating mechanism to be obtained. The thermosetting material provides the advantage of a good dielectric strength after breaking. In practice, the shaft can be made of bulk thermosetting material. Alternatively, the shaft can have a metallic body covered with an insulating material.

The circuit breaker advantageously comprises at least one connecting rod between the pole shaft and each movable contact part, linked to the pole shaft by a pivot in such a way that in a certain relative position of the shaft and of the rod, called the assembly position, the rod can be freely moved in a direction parallel to the axis of the pivot, and that once the rod has been fitted and moved from its fitting position, a positive link is achieved preventing translational motion of the rod in a direction parallel to the axis of the pivot, the assembly position being such that in the operating state, the pole shaft and rod never take this position.

BRIEF DESCRIPTION OF THE DRAWINGS

Other advantages and features of the invention will become more clearly apparent from the following description of an embodiment of the invention, given as a non-restrictive example only and represented in the accompanying drawings in which.

DETAILED DESCRIPTION OF THE PREFERRED EMBODIMENT

Figure 1:
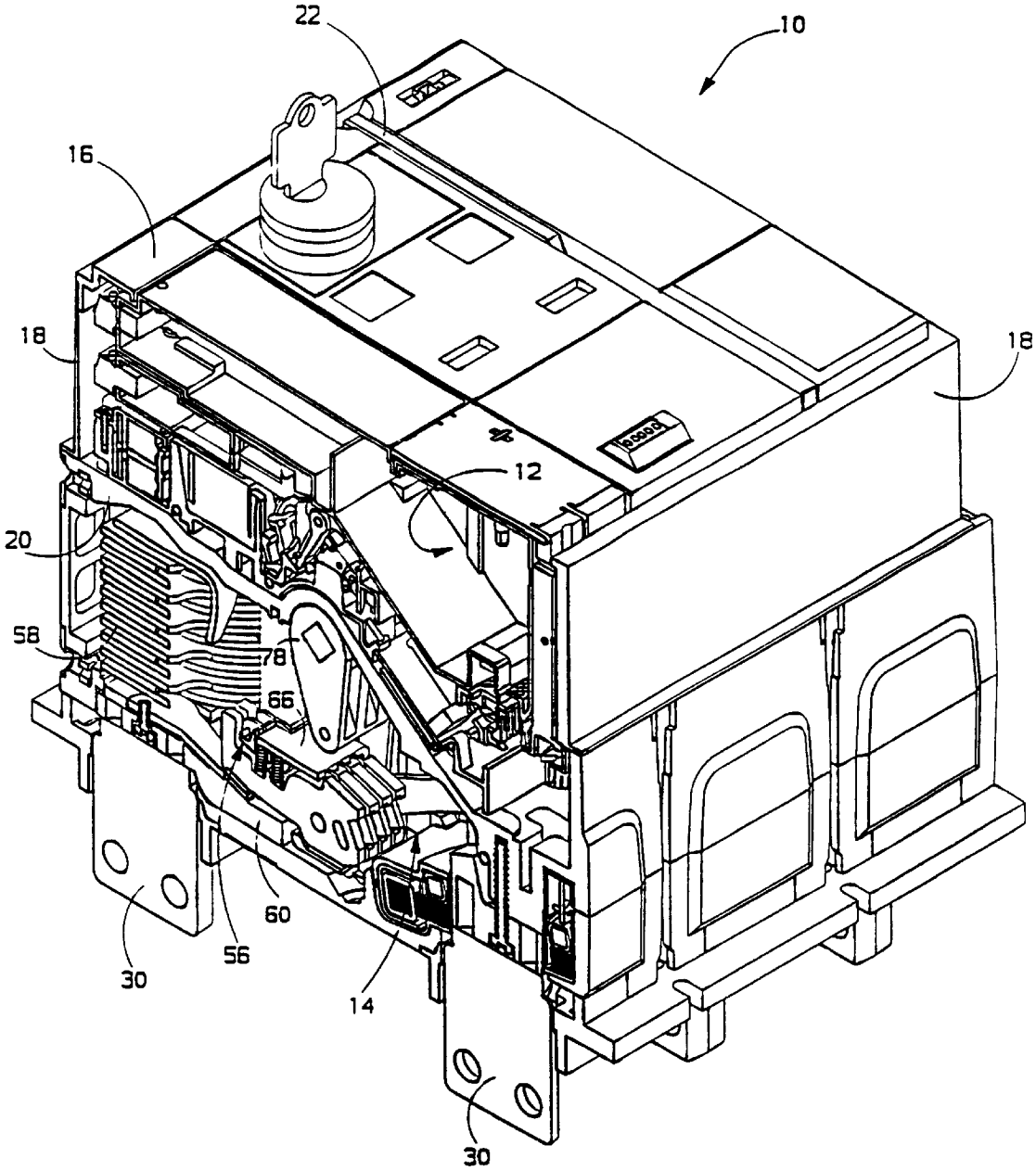
FIG. 1 represents a perspective view of a circuit breaker according to the invention, cut away at the level of a pole.
Figure 2:
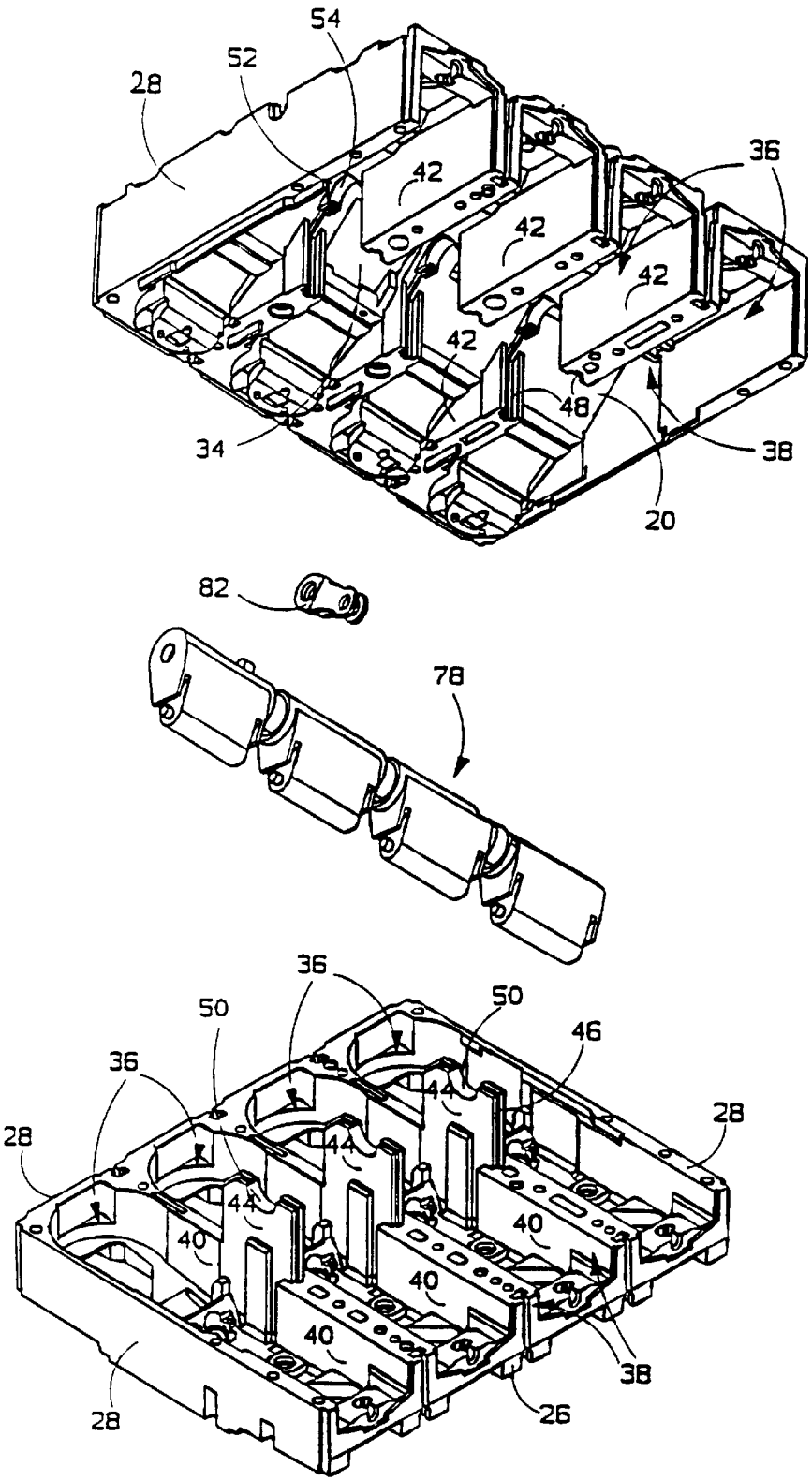
FIG. 2 represents an exploded view of a pole shaft and of a part of a case of the circuit breaker according to the invention.
Figure 3:
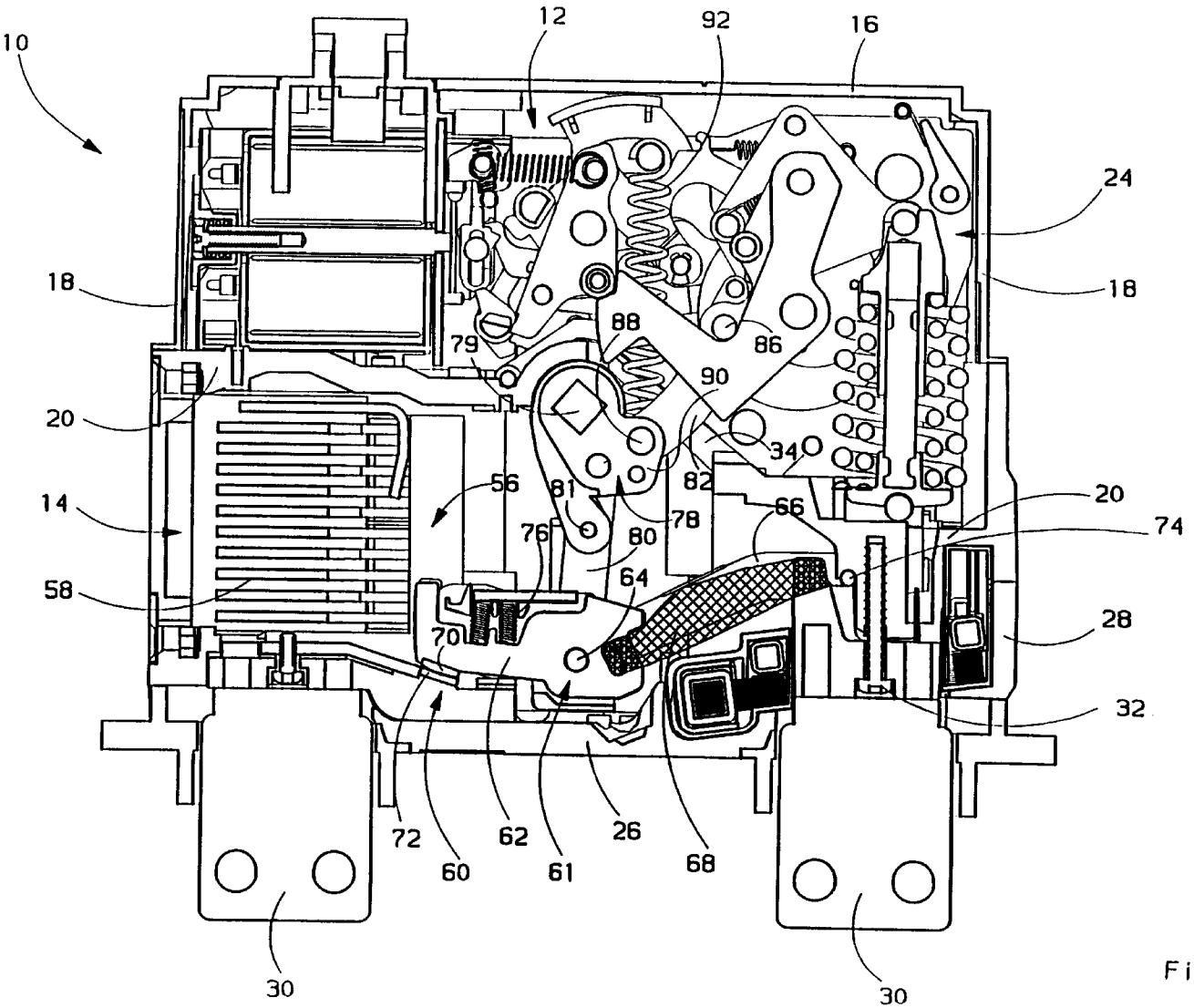
FIG. 3 represents a cross section of the circuit breaker of FIG. 1, in the closed position.

With reference to FIGS. 1 to 3, a low-voltage non-limiting circuit breaker 10 with high electrodynamic strength is arranged in a molded case comprising a front compartment 12 and a rear compartment 14. The front compartment 12 is limited by a front panel 16, side panels 18 cast with the front face, and an intermediate wall 20 separating it from the rear compartment. It comprises openings on the front panel for passage of a pivoting handle 22 for performing resetting of an operating mechanism 24 of the circuit breaker, an opening pushbutton and a closing pushbutton. The operating mechanism 24 is housed in the front compartment 12.

The rear compartment 14 is limited by the intermediate wall 20, by a back plate 26 constituting a rear panel, and by side panels 28 a part of which is cast with the back plate and another part of which is molded with the intermediate wall. The back plate 26 supports connecting strips 30 for connection of the circuit breaker 10 to an external electrical circuit. The back plate 26 and intermediate wall 20 are fixed to one another by means of fixing screws 32 dimensioned so as to be able to withstand high shear stresses. A window 34, visible in particular in FIG. 2, is arranged in the intermediate wall 20 and allows communication to take place between the front compartment 12 and the rear compartment 14. The rear compartment 14 is sub-divided into individual compartments 36 by separating partitions 38. Each partition 38 comprises two lateral parts arranged on each side of a central part. Each lateral part comprises a partition element 40 molded with the back plate and a partition element 42 molded with the intermediate wall, the partition elements 40, 42 being joined on the assembled unit. The central part comprises a partition element 44 molded with the back plate of a larger height than the adjacent lateral elements 40. This partition element 44 comprises ribs 46 cooperating when assembly is performed with complementary grooves 48 of the lateral partition elements 42 securedly united to the intermediate wall 20. The central partition element 44 of the back plate comprises a smooth semi-cylindrical surface 50. The intermediate wall 20 comprises a complementary central partition element 52 of smaller height which also comprises a smooth semi-cylindrical surface 54 facing that of the element securedly united to the back plate.

Figure 4:
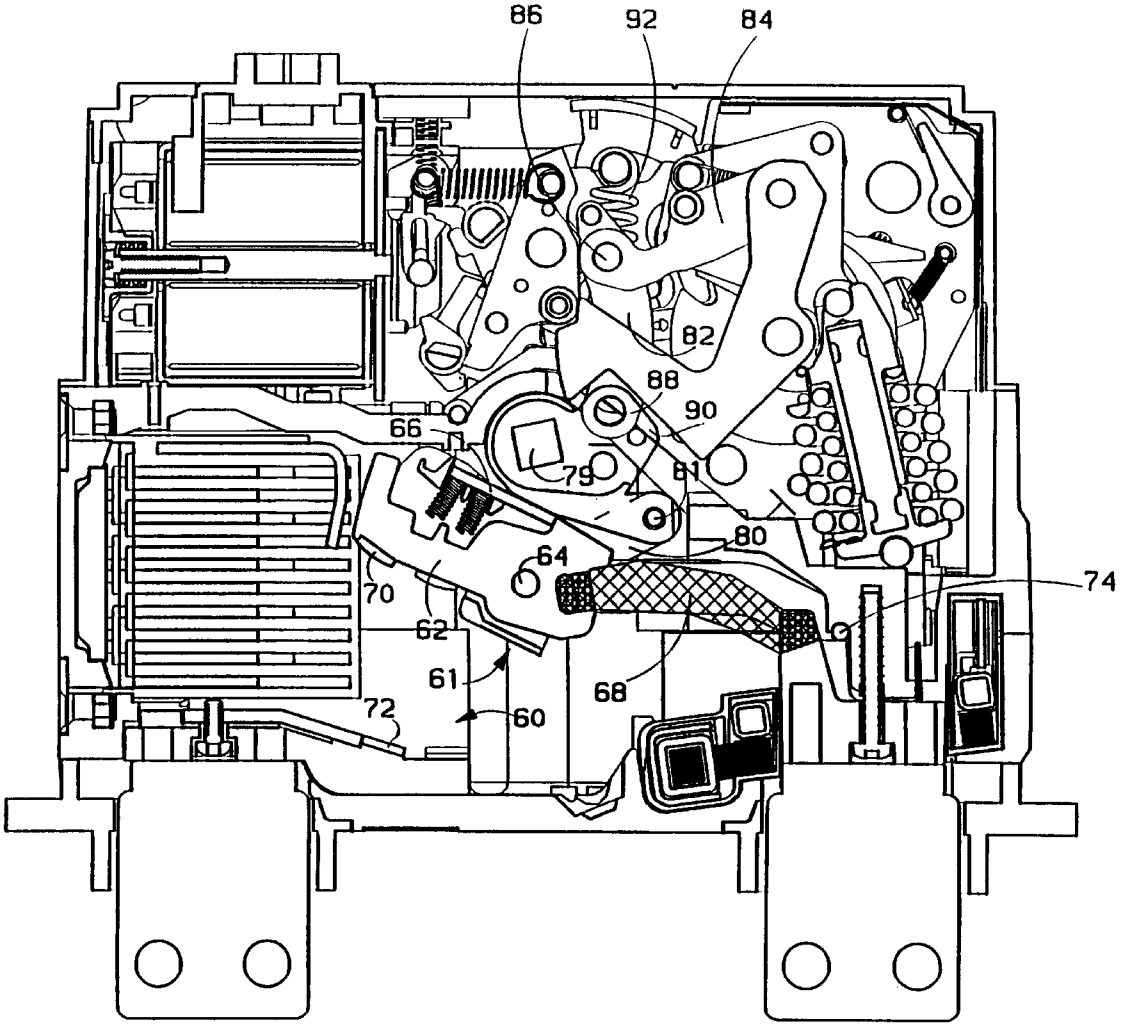
FIG. 4 represents a cross section of the circuit breaker of FIG. 1, in the open position.
Figure 5:
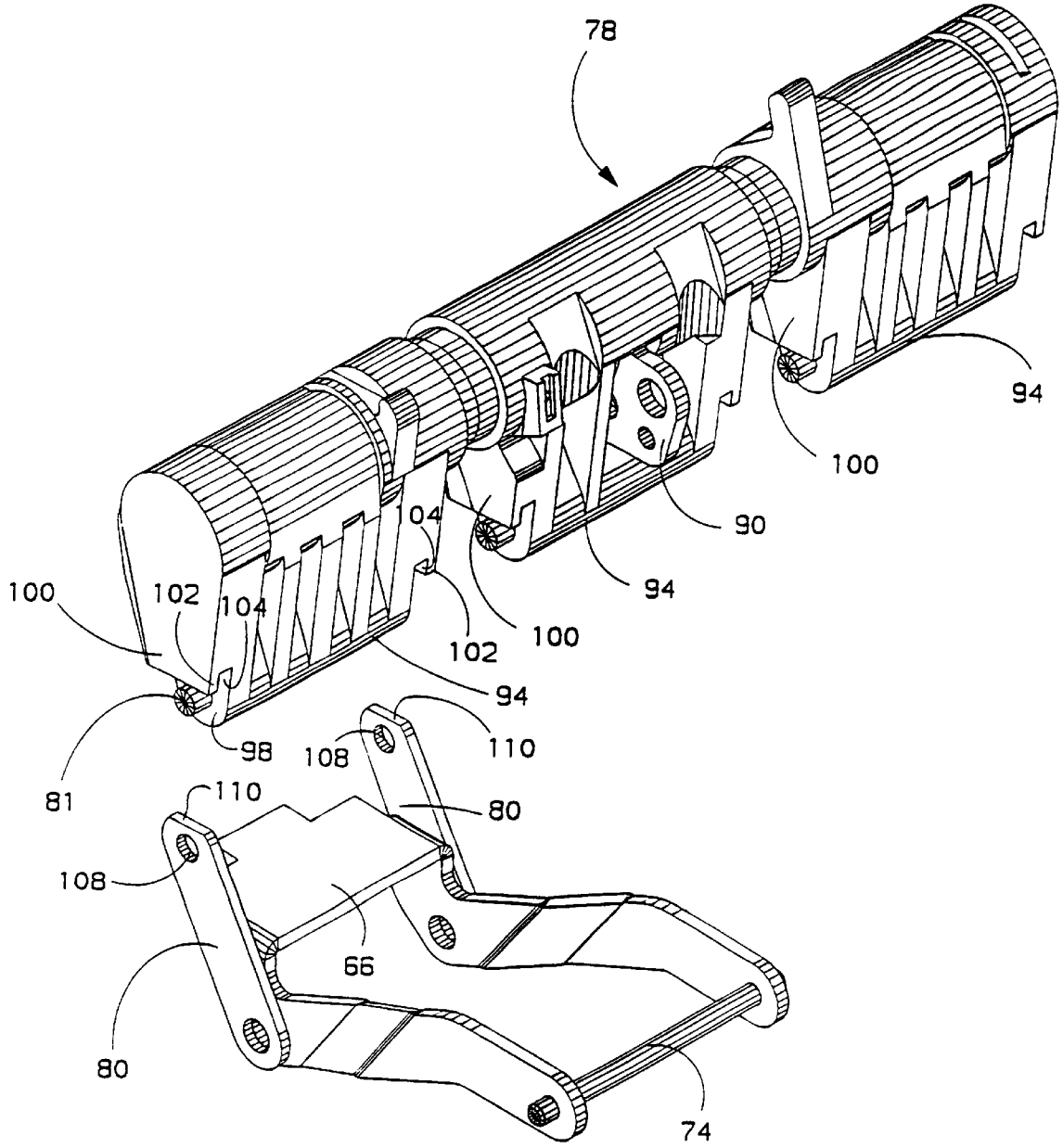
FIG. 5 represents a perspective view of the pole shaft and of a connecting rod to one of the poles in a position preceding their assembly.
Figure 6:
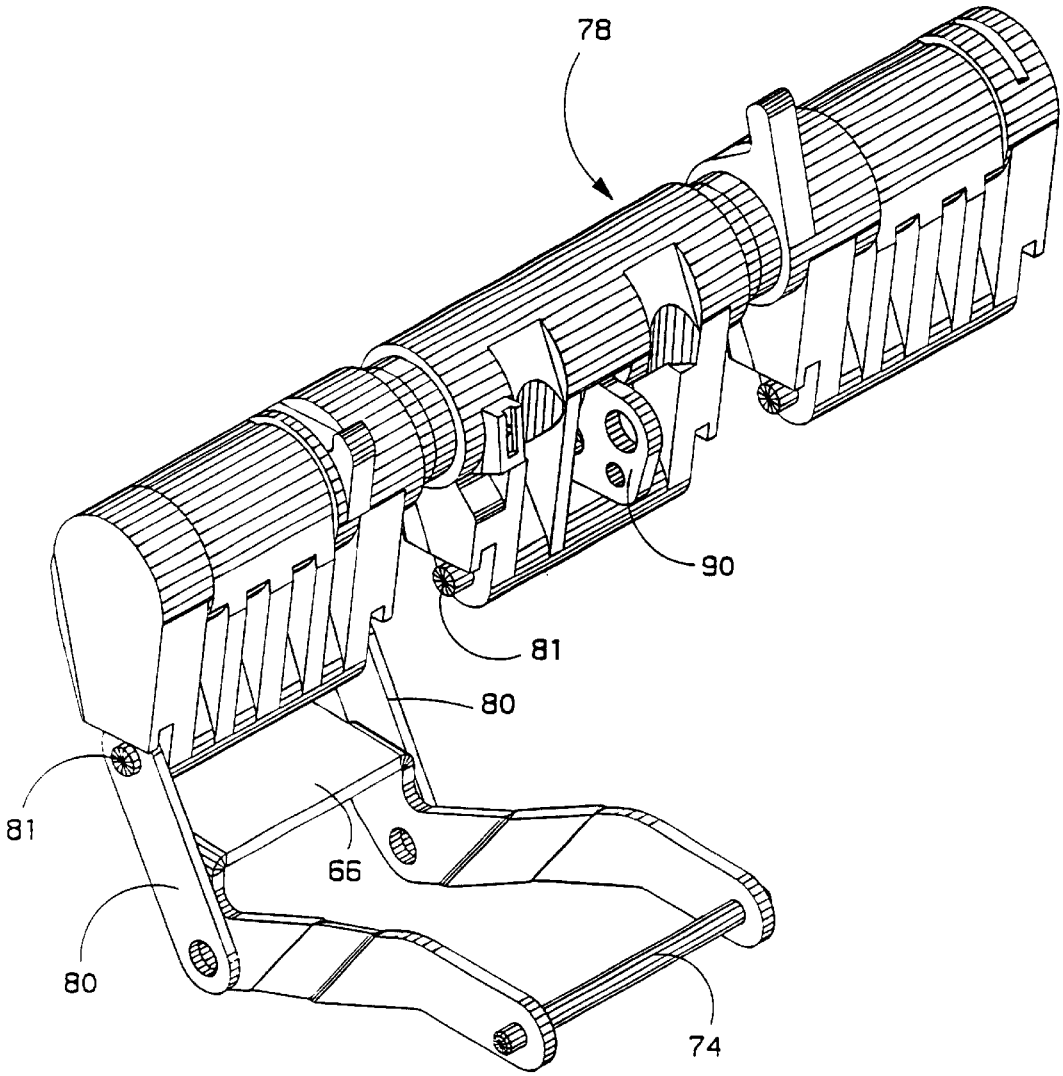
FIG. 6 represents a perspective view of the pole shaft and of a connecting rod for connection to one of the poles in a respective position called the assembly position.
Figure 7:
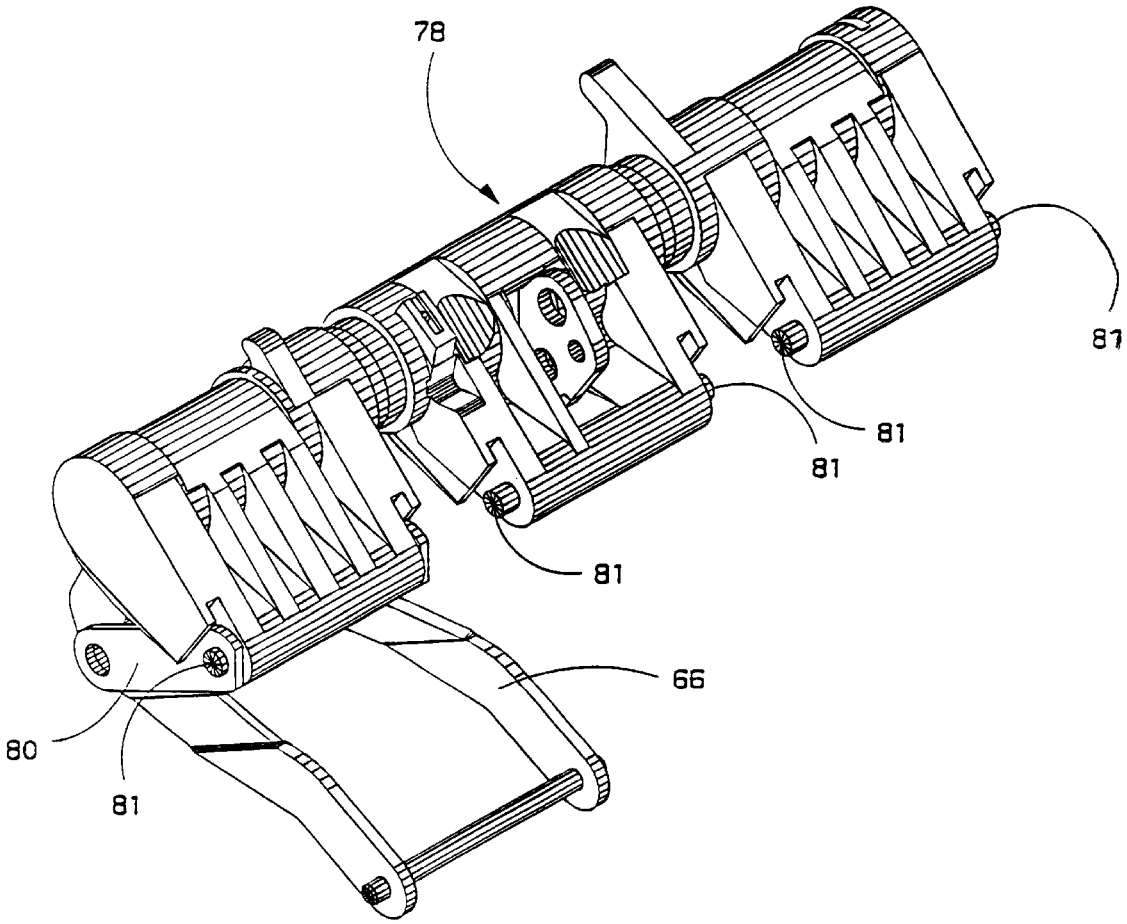
FIG. 7 represents a perspective view of the pole shaft on which the connecting rod is fitted, in their positioning with respect to one another when the circuit breaker is open.
Figure 8:
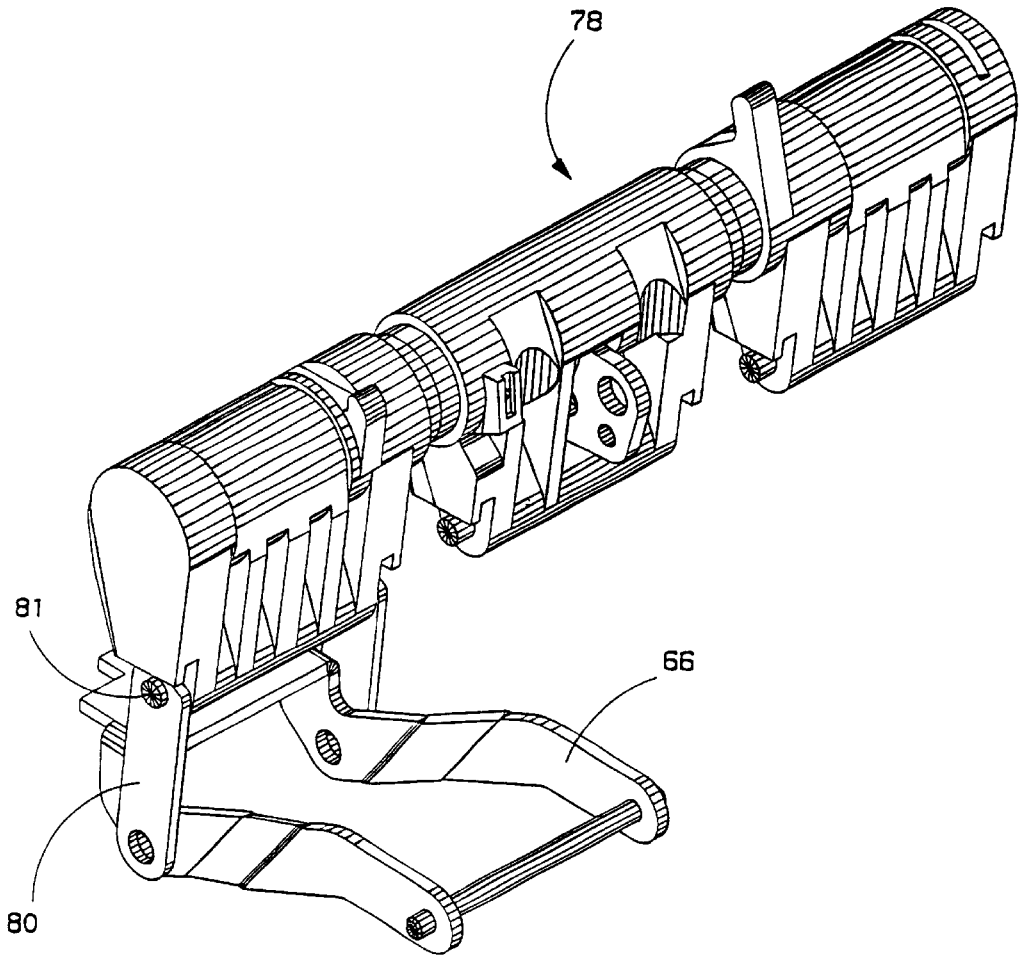
FIG. 8 represents a perspective view of the pole shaft on which the connecting rod is fitted, in their positioning with respect to one another when the circuit breaker is closed.

A pole 56 of the circuit breaker is housed in each individual compartment 36. Each pole 56 comprises an arc extinguishing chamber 58 and a separable contact device. The latter comprises a stationary contact part 60 electrically connected to a connecting strip 30 of the circuit breaker passing through the back plate 26 of the insulating case, and a movable contact part 61. The latter is provided with a plurality of contact fingers 62 in parallel mounted pivoting on a first transverse axis 64 supported by a support tunnel 66. The heel of each finger is connected by a flexible conductor 68 formed by a metallic braided strip to a second connecting strip 30 of the circuit breaker. Each finger 62 comprises a contact pad 70 cooperating with a pad 72 of the stationary contact part 60 in the closed position of FIG. 3. The tunnel 66 is U-shaped (cf. FIG. 5). Its end situated near to the second connecting strip is equipped with an axis 74 housed in a bearing securedly united to the insulating case, so as to enable pivoting of the tunnel 66 between a closed position of the pole 56, represented in FIG. 3, and an open position, represented in FIG. 4. A contact pressure spring device 76 is arranged in a notch of the tunnel 66 and urges the contact fingers 62 to pivot in a counterclockwise direction around the first axis 64.

The arc extinguishing chamber 58 comprises a stack of deionization plates of the electrical arc drawn when separation of the poles takes place, and also orifices for outlet of the extinguishing gases. Further details on the structure of the poles 56 can be found in the document FR-A-2,650,434, the description of which is on this point incorporated herein by reference.

A pole shaft 78 is placed between the semi-cylindrical sectors 50, 54 which, once assembled, form tight bearings supporting the shaft 78 in rotation around its axis 79. The shaft 78 is molded from thermosetting polyester. Each of the tunnels 66 is coupled to the pole shaft 78 by a pair of parallel transmission rods 80 which pivot around a geometrical axis which is the same as the axis 64. Each rod 80 is linked to the pole shaft 78 by a pivot 81.

The operating mechanism 24 comprises an energy storage closing device and an opening device. This mechanism is known as such and for further details reference should be made to the document FR-A-2,589,626 which is on this point incorporated herein by reference. It will merely be recalled here that the opening device comprises a toggle device which comprises two rods 82, 84 articulated on one another by a pivoting axis 86, the lower transmission rod 82 being mechanically coupled to the pole shaft 78 by a pivoting axis 88 operating in conjunction with a bearing made in crank 90 securedly united to the shaft 78. An opening spring 92 is secured between the axis 88 and a fixed securing spigot. FIG. 3 shows that in the closed position the window 34 made in the intermediate wall 20 serves the purpose of allowing the lower transmission rod 82 and the opening spring 92 to pass through. In the closed position, the leverage of the rods 80 on the pole shaft 78 is appreciably lower than that of the transmission rod 82. In other words, the distance between the axis 79 of the pole shaft 78 and the plane which contains the axes 64, 81 of the pivots of the rods 80 is smaller than the distance between the axis 79 of the pole shaft 78 and the plane which contains the axes 86, 88 of the pivots of the lower transmission rod 82. In practice, the ratio of the two distances is less than 0.3.

In the closed position represented in FIG. 3, it can be observed that for each pole 56 that the contact pads 70 of the contact fingers 62 are pressing on the pad 72 of the stationary contact part 60. The contact pressure is provided by the spring device 76 which enables any possible play of the mechanism and wear of the pads 70, 72 to be compensated. The electrodynamic forces exerted on the contact fingers 62 are taken up at the level of the tunnel 66 by the bearing surfaces of the springs 76 and by the axis 64, and generate a moment around the pivoting axis 74 of the tunnel 66 tending to make the tunnel 66 pivot in the direction of separation of the contacts. This moment is compensated by an opposite moment exerted by the rods 80 on the tunnel 66 at the level of their relative pivoting axis 64. At dynamic equilibrium, the rods 80 are therefore subjected at the level of their link pivot 64 connecting them to the tunnel 66 to a force directed towards their link pivot 81 connecting them with the pole shaft 78. This force, transmitted to the pivot 81, generates a moment around the axis 79 of the pole shaft 78. The same phenomenon occurs for each of the poles. A moment generated by the lower transmission rod 82 of the opening device toggle is opposed to the sum of the moments of the forces exerted by all the rods 80 and by the opening spring 92 on the shaft 78. Due to the relative position of the rods 80, the transmission rod 82 and the pole shaft 78, i.e. to the weakness of the leverage of the rods 80 compared with that of the transmission rod 82, the resultant at the level of the transmission rod 82 remains moderate. The characteristics of a circuit breaker of high electrodynamic strength are therefore to be found here, as the electrodynamic forces on the contact parts only generate limited stresses on the operating mechanism so that the latter can oppose them. At equilibrium, the pole shaft 78 exerts pressure forces at the level of the support bearings the resultant of which forces is a reaction force opposing the sum of the forces exerted by the rods 80 and the transmission rod 82. These relatively high pressure forces are exerted mainly on the semi-cylindrical sector 54 formed in the intermediate wall 20.

When opening of the circuit breaker takes place, the rod 82 stops opposing counter-clockwise rotation of the pole shaft. This rotation, generated jointly by the opening spring 92 and the resultant of the electrodynamic forces at the level of the link pivots 81 of the rods 80 and of the shaft 78, drives all the tunnels 66 to the open position represented in FIG. 4. In this position, the crank 90 of the pole shaft 78 emerges slightly from the window 34.

FIGS. 5 to 8 describe the assembly mode of the link by pivot between the pole shaft 78 and the connecting rods 80 with each tunnel 66. The pole shaft 78 comprises, for each pole, an arm 94 bearing two coaxial pivots 81 eccentric with respect to the pivoting axis 79 of the pole shaft 78. These pivots 81 are each situated on a notch 98 of the side face 100 of the arm. A tab 102 overhanging the notch 98 materializes a groove 104.

Each rod 80 comprises, on the side designed to operate in conjunction with the shaft 78, a cylindrical bore 108 designed to form a bearing for one of the pivots 81, and a flat part 110. When assembly takes place, the rod 80 is presented in such a way that the flat part 110 is parallel with the bottom edge of the tab 100, in the relative assembly position represented in FIG. 6. It is then possible to insert the pivots 81 in the bores 108. Once assembled, the assembly formed by the rods 80 and the pole shaft 78 is placed in the case, where it oscillates between two extreme positions: a position corresponding to opening of the contacts and represented in FIG. 7 and a position corresponding to closing of the contacts and represented in FIG. 8. In both of these positions, as well as in all the intermediate positions, the rods 80 operate in conjunction with the corresponding grooves 104 of the pole shaft 78, which form a guide preventing any movement of the rods 80 in a direction parallel to the pivoting axis 81. A simple positive link is thus achieved which does not require the use of any additional intermediate part.

Naturally, the invention is not limited to the example described above. It is clear for example that the pivoting axis of the rods 80 on the tunnels 66 is not necessarily the same as the pivoting axis of the fingers 62. There may moreover be only one rod 80 per pole. Furthermore, arrangements can be made to increase the tightness at the level of the bearings passing through the partitions. A bearing can thus be provided having a zigzag profile with a central annular groove operating in conjunction with a complementary asperity of the shaft. Additional bearings can also be provided at the level of the external side walls of the case. The circuit breaker described in the example comprises an energy storage mechanism. However, within the scope of the invention, the operating mechanism of the pole shaft can be of any kind. The mechanism described can therefore be replaced by any other known mechanism, whether it be a mechanism with manual or motor-driven resetting.

What is claimed is:

1. A low-voltage circuit breaker of high electrodynamic strength with a case made of insulating material, comprising an operating mechanism linked to a pole shaft supported by bearings securedly affixed to the case, a plurality of poles, each pole comprising at least one pair of separable contact parts, one at least of the contact parts of each pair, called the movable contact part, being mechanically linked to the pole shaft, the pole shaft, operating mechanism and movable contact part being able to move between an open position corresponding to separation of the contact parts of each pair and a closed position corresponding to contact between the contact parts of each pair, the case of the circuit breaker comprising a front compartment housing the operating mechanism and a rear compartment separated from the front compartment by an intermediate wall and subdivided into individual compartments by separating partitions, each individual compartment housing one of the poles of the circuit breaker, wherein the rotation axis of the pole shaft is located in the rear compartment.

2. The circuit breaker according to claim 1, wherein each of said separating partitions supports one of said bearings and the pole shaft passes through each partition at the level of one of said bearings.

3. The circuit breaker according to claim 2, wherein each of said separating partitions comprises a partition element molded with the intermediate wall, in an edge of which wall there is formed a semi-cylindrical sector forming a part of the corresponding bearing.

4. The circuit breaker according to claim 1, wherein the intermediate wall comprises a window for passage of a mechanical link part between the pole shaft and the operating mechanism.

5. The circuit breaker according to claim 1, wherein the external surface of the pole shaft is made of electrically insulating material.

6. The circuit breaker according to claim 1, comprising at least one connecting rod between the pole shaft and each movable contact part, this rod being linked to the pole shaft by a pivot in such a way that in a certain relative position of the shaft and of the rod, called the assembly position, the connecting rod can be freely moved in a direction parallel to the axis of the pivot, and once the connecting rod has been fitted and moved from its fitting position, a positive link is achieved preventing translational movement of the rod in a direction parallel to the axis of the pivot, the assembly position being such that in the operating state, the pole shaft and rod never take this position.

* * * * *